US007206429B1

(12) United States Patent
Vossler

(10) Patent No.: US 7,206,429 B1
(45) Date of Patent: Apr. 17, 2007

(54) AUDIO EARPIECE AND PERIPHERAL DEVICES

(75) Inventor: Stephen P. Vossler, Sioux Falls, SD (US)

(73) Assignee: Gateway Inc., Irvine, CA (US)

( * ) Notice: Subject to any disclaimer, the term of this patent is extended or adjusted under 35 U.S.C. 154(b) by 1038 days.

(21) Appl. No.: 09/862,766

(22) Filed: May 21, 2001

(51) Int. Cl.
*H04R 25/00* (2006.01)

(52) U.S. Cl. ..... 381/381; 381/322; 181/130; 455/575.2

(58) Field of Classification Search ..... 381/381, 381/151, 163, 380, 379, 71.6, 375, 370, 371, 381/376, 322, 328, 330, 158, 334, 385; 455/566, 455/575, 88, 575.2, 41.1, 90; 379/430; 181/129, 181/130; 369/30.27, 59.21, 30.04
See application file for complete search history.

(56) References Cited

U.S. PATENT DOCUMENTS

| | | | | |
|---|---|---|---|---|
| 4,654,883 | A * | 3/1987 | Iwata | 381/380 |
| 5,655,026 | A * | 8/1997 | Peters et al. | 381/385 |
| 5,659,156 | A * | 8/1997 | Mauney et al. | 181/130 |
| 6,122,388 | A * | 9/2000 | Feldman | 381/322 |
| 6,230,029 | B1 * | 5/2001 | Hahn et al. | 455/575.2 |
| 6,449,374 | B1 * | 9/2002 | Skulley et al. | 381/381 |
| 6,606,506 | B1 * | 8/2003 | Jones | 455/566 |
| 6,728,388 | B1 * | 4/2004 | Nageno et al. | 381/381 |

FOREIGN PATENT DOCUMENTS

WO 00/75924 A1 12/2000

OTHER PUBLICATIONS

"900 MHz Wireless Transmitter—Wireless Beltpack Receiver—Earbuds with Winder Case", http://www.smarthome.com/imges/8227big.jpg, 1 page.
"Etronixs.com—Koss KSC-5Ultra Lightweight Clip Design Ear Buds", http://www.etronixs.com/ksc-5.html, 1 page.
"Gizmomall.com—Casio Audio Recorder Watch", http://www.gizmomall.com/static/105800.html, 1 page.
"Music4Free.com—Wrist Audio Player", wvsiwyg://68/http://www.hardware.music4free.com/review.php?main_ID=25, 3 pages.
"Personal MP3 Audio Player", http://www.smarthome.com/9701.html, 4 pages.
"Power Suit is Redefined", *Wall Street Journal Europe*, p. 21, (Aug. 21, 2000).
"Smarthome.com—MP3 Watch—Take Your Music Wit You Wherever You Go!", http://www.smarthome.com/8102.html, 2 pages.
"Smarthome.com—Wireless Headphone System—Make Any Headphones Wireless!", http://www.smarthome.com/8227.html, 2 pages.
"Wireless Internet Audio Transmitter", http://www.smarthome.com/images/8226big.jpg, 1 page.

* cited by examiner

*Primary Examiner*—Ali Neyzari
(74) *Attorney, Agent, or Firm*—Jeffrey A. Proehi; Woods Fuller Shultz & Smith PC

(57) ABSTRACT

An audio player is constructed in an ear module fully supported by the ear. The ear module is an in ear canal device, or ear bud with a clip that securely attaches it to the ear. The ear module contains all components required for storing and playing digitized audio such as MP3, RealAudio, WMA or ASF. The ear module is coupled to a hub that is also fully supported by the ear. The hub comprises a micro controller and connectors for receiving digitized audio. The hub has a connector hub from which peripheral devices are supportable.

23 Claims, 6 Drawing Sheets

AUDIO EARPIECE AND PERIPHERAL DEVICES

FIELD OF THE INVENTION

The present invention relates to personal audio players and in particular to an audio earpiece for playing prerecorded audio signals.

BACKGROUND OF THE INVENTION

Audio players that store digital audio signals are widely available. Many take the form of a headset coupled to a digital storage/player device, such as an MP3 player. MP3 is a format for compressed audio signals. MP3 is part of MPEG-1 Audio Layer 3 which uses a perceptual coding method and enables audio signals to be compressed at high compression rate without a deterioration of sound quality by removing weak signals behind strong signals. The compression rate is high enough to contain an eight-hour-long audio data in a CD_ROM with nearly the same sound quality as the original sound.

The MP3 player is held or carried by the user, making it inconvenient for physical activities. The MP3 player has been incorporated into watches, as well as containers that are carried in pockets or clipped to clothing. In one prior audio player, the player device is built into the band between the speakers of the headset. However, this type of audio player is obtrusive, and not fully conducive to physical activity. Further, transport and storage of the audio player may easily result in damage to the player and speakers.

SUMMARY OF THE INVENTION

An audio player is constructed in an ear module fully supported by the ear. In one embodiment, the ear module is an in ear canal device. In a further embodiment, the ear module is formed as an ear bud with a clip that securely attaches it to the ear. The ear module contains all components required for storing and playing digitized audio. In one embodiment the audio player is an MP3 player, RealAudio player or ASF player.

In a further embodiment, the ear module comprises a speaker and battery. The ear module is coupled to a hub that is also fully supported by the ear. The hub comprises a micro controller and connectors for receiving digitized audio. It alternatively comprises a battery for running the audio player.

In one embodiment, the hub has a connector hub from which peripheral devices are supportable. Such devices include solar collectors, batteries, memory, display devices, ROM music releases and external control devices such as an on/off switch, volume control, track selection controls and others.

DETAILED DESCRIPTION OF THE INVENTION

In the following description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

An audio player which is fully supported by the ear is first described, followed by description of alternative embodiments and a description of components of the audio player. A method of distributing digital audio recording is then described.

Figure 1A:
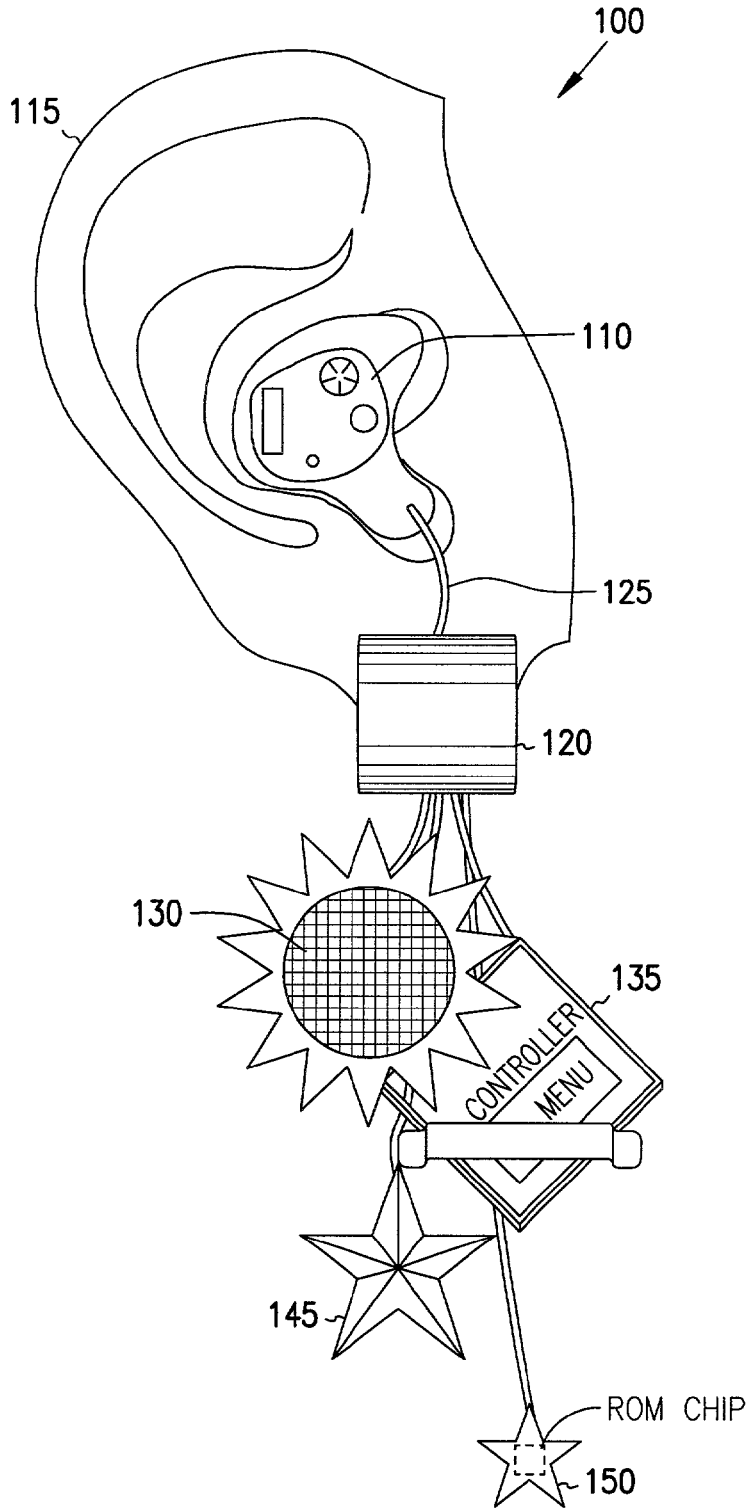
FIG. 1A is a block perspective diagram of an audio player constructed in accordance with the present invention.
Figure 1B:
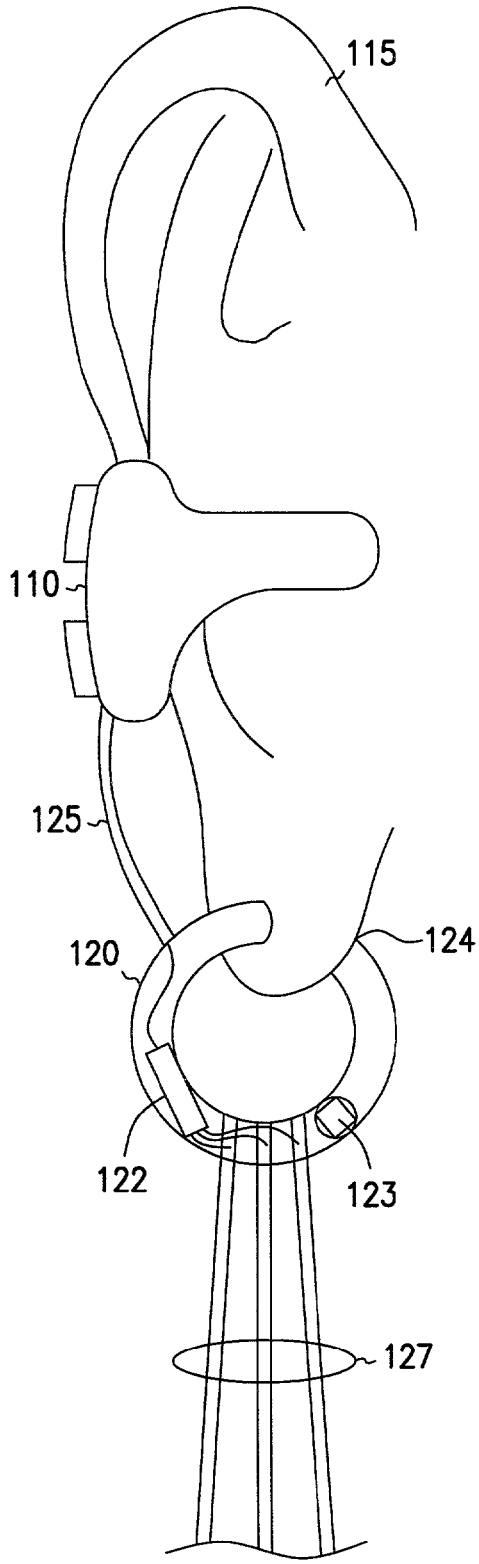
FIG. 1B is a partial block side sectional view of the audio player of FIG. 1A.

An audio player is shown generally at 100 in FIGS. 1A and 1B. The audio player 100 comprises an ear module 110 formed to be supported by an ear clip 115. In one embodiment, the ear module 110 comprises all the elements of an MP3 or other audio player, such as a speaker, microphone, battery, memory for storing digitized audio and a player that provides audio signals to the speaker based on the digitized audio, including some external controls as shown. Further details of such components and their operation will be described below.

In a further embodiment, the audio player 100 further comprises a hub 120 formed in a "C" shape. The hub 120 has a hinge 123 to allow the hub to open and shut about the earlobe. When in the shut position as shown, hub 120 contacts the earlobe with soft grippers in one embodiment. In one embodiment, the hub 120 is coupled to the ear module by suitable connector 125 that provides audio signals to the ear module based on stored digitized audio signals. A plurality of peripheral devices are attached to and supported by the hub 120 by connectors 127. The connectors comprise multiple conductors and are suitable for various types of peripheral devices. A detent is included with each connector to removeably secure them to the hub 120. The peripheral device include, but are not limited to a solar collector 130 with charging circuit, extra replaceable or disposable battery 135, and ROM or RAM memory devices 145 and 150 for storing music releases and personal profiles. Further peripheral devices include a transceiver that facilitates sharing of music and personal profiles with other devices, and a display device such as an LED or LEP synchronized with the music being played, displaying status, an album cover or other desired images. The connectors to the hub may vary depending on the peripheral device. The solar collector and extra battery are simple two wire connectors, while the connectors for music releases 145 and 150 comprise a parallel bus, or other bus suitable for communication of MP3 digitized audio signals. The music releases are stored on ROM in one embodiment or other writable persistent memory that can be encapsulated in a decorative package, such as the star shapes shown at 145 and 150. The decorative package is varied in one embodiment, and is constructed to appear like jewelry. The decorative packages identify the source of the music. It serves both as a trademark to help consumers identify music releases from particular groups, and to identify music being listened to by a user. In one embodiment, other peripheral devices are also formed to appear like jewelry. The peripheral devices so packaged are likely to become collectibles, especially if limited releases are produced.

In one embodiment, a musical group produces music and stores it in a digital format such as MP3 (Moving Picture Experts Group Layer-3 Audio), RA (RealAudio), WMA (Windows Media Audio), ASF (Active Streaming Format), AU (Audio file), AUD (Audio file), AIF (Auxiliary Information File), ASX (Active Streaming XML), ASF (Active Streaming Format (Microsoft)), MIDI (Musical Instrument Digital Interface), RMI (Real Music Interface), SND (Sound file) WAV (Windows Audio Volume) WAX (Windows Audio Executable), or WM (Windows Media) formats to name a few of the many potential digital formats currently available or available in the future. The group then selects a decorative theme, similar to a logo, and uses that theme for encapsulating the ROM chip with the music releases stored in digital format on persistent memory. The theme or logo is then used as the subject of a trademark application or is otherwise protected by intellectual property rights. The encapsulated music releases are then distributed to consumers.

In further embodiments, peripheral devices suitably coupled to and supported by the hub 120 comprise extra battery memory which is used to store MP3 or other digital audio which may be downloaded from a computer via a data connector, such as USB, telephone, RCA, USB, Blue Tooth, EMP (electromagnetic pulse) etc. Such data connectors are incorporated into a peripheral device coupled to the hub 120, the hub 120 itself, or the ear module 110 in various embodiments.

Still further peripheral devices coupled to hub 120 include RF, IR and EMP receivers, RF transmitters, RF transceivers, transceivers implementing wireless communication protocols such as Bluetooth, IR and dispersed IR transceivers and carriers for removable media such as memory sticks, external display devices such as LED, LCD, LEP, etc., and external control devices including a pressure sensitive on/off switch. In one embodiment, a transceiver is utilized to communicate with a cellular phone, essentially becoming a speaker and microphone for the cellular phone. The transceiver is also available to share music with other players similarly equipped.

In a further embodiment, various functions of the peripheral devices are incorporated into the hub or the ear module as desired. In one embodiment, a second ear module is provided for the second ear. It coordinates playing audio sound with the first ear module via wireless communication capabilities provided in a peripheral device, or implemented within the ear modules themselves or the hub 120.

Figure 2:
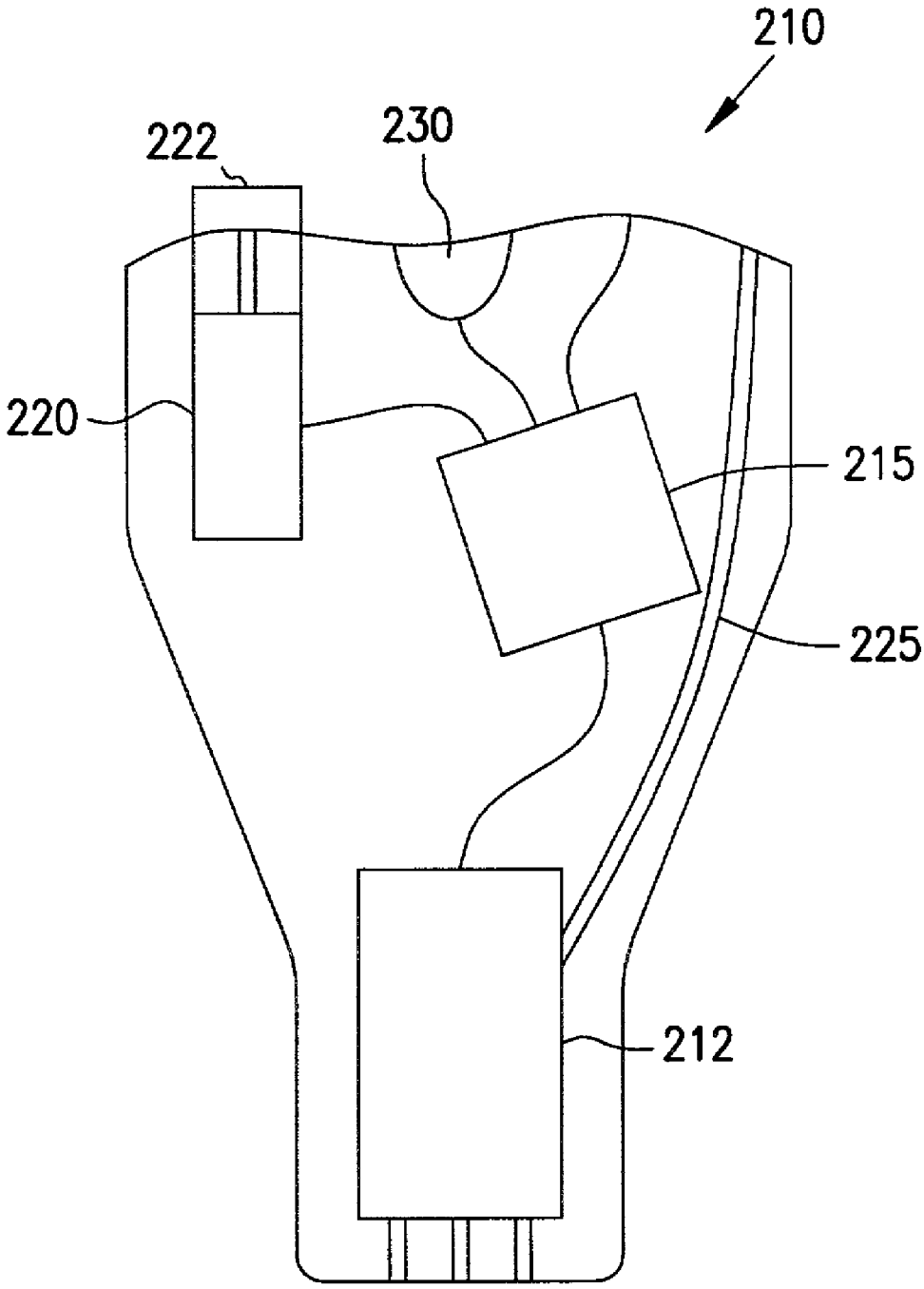
FIG. 2 is a diagram of an in canal ear module constructed in accordance with the present invention.

FIG. 2 shows an ear module in the form of an in the canal device (ITC) generally at 210. Other forms include completely in the canal (CIC), in the ear (ITE) and behind the ear (BTE). The shape of the in the canal device 210 is formed similarly to an in the canal hearing aid which is modifiable to conform to individual ear canals. In this embodiment, all necessary electronics for the MP3 player are included in the device. A speaker is shown at 212 coupled to a controller/memory 215. A battery 220 is also coupled to the controller 215 to provide power. A connector from the battery 220 is provided to an outer surface for recharging the battery. The connector comprises at least two wires to permit recharging. An access door 222 provides access to the battery for replacement. A connector to the surface is also provided from controller 215 to one or more switches for providing user input, and to further connect to a hub in further embodiments. An air passage 225 extends from the speaker 212 to the outer surface to ensure pressure is equalized within the ear.

In a further embodiment, a microphone 230 is coupled to the controller 215. Microphone 230 provides controllable audio passthrough. Such audio passthrough is used in combination with a transceiver and the speaker to provide an I/O interface for a cellular phone with a similar transceiver. The microphone also provides for voice control of the MP3 player functions.

Figure 3:
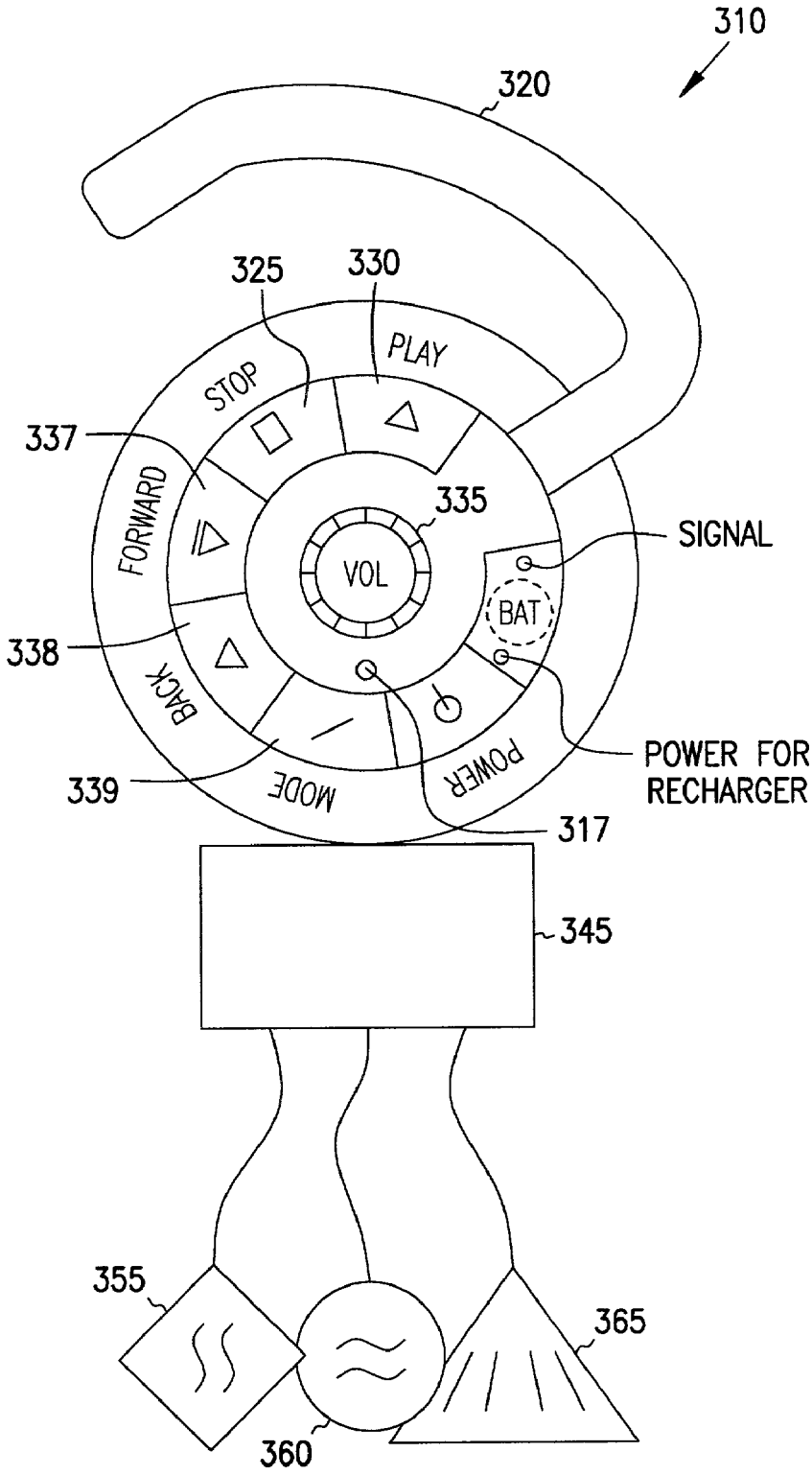
FIG. 3 is a block perspective diagram of an alternative audio player constructed in accordance with the present invention.

An alternative embodiment of an audio player is shown generally at 310 in FIG. 3. An ear module comprises a speaker assembly 315 and an ear clip 320 coupled to the speaker assembly 315 for being totally supported by an ear. The player further comprises a microphone 317 for receiving sounds, including the voice of the wearer and providing them to the controller. The ear module further comprises a plurality of controls easily accessible by a user. The controls include a stop button 325, play button 330 and volume dial 335, forward button 337, back button 338, mode advance button 339 and power button 340. The controls are common for MP3 players with the exception of the mode advance button 339. Mode advance button 339 provides the ability to advance the player through different modes, including modes such as play mode for MP3 stored music, passthrough mode and cell phone mode. During passthrough mode, the player is operable as a normal hearing aid, providing various amplifications of bands of frequencies to compensate for hearing loss. In cell phone mode, the speaker and microphone of the player provide I/O for the cell phone by means of compatible transceivers in the player and phone.

A hub 345 is supported directly by the ear module in this embodiment. The hub 345 and ear module communication via a parallel connector or other suitable connector for transferring power and or audio signals to and from the ear module. The hub 345 further supports peripheral devices 355, 360 and 365 such as those previously described. The ear module implements all functions required for a fully functional MP3 player in one embodiment. As such, it has a data port for receiving MP3 digital signals and storing them on a memory for later play. The data port is used in further embodiments for supporting the hub, which provides power, digital audio signals or analog audio signals as desired.

Figure 4:
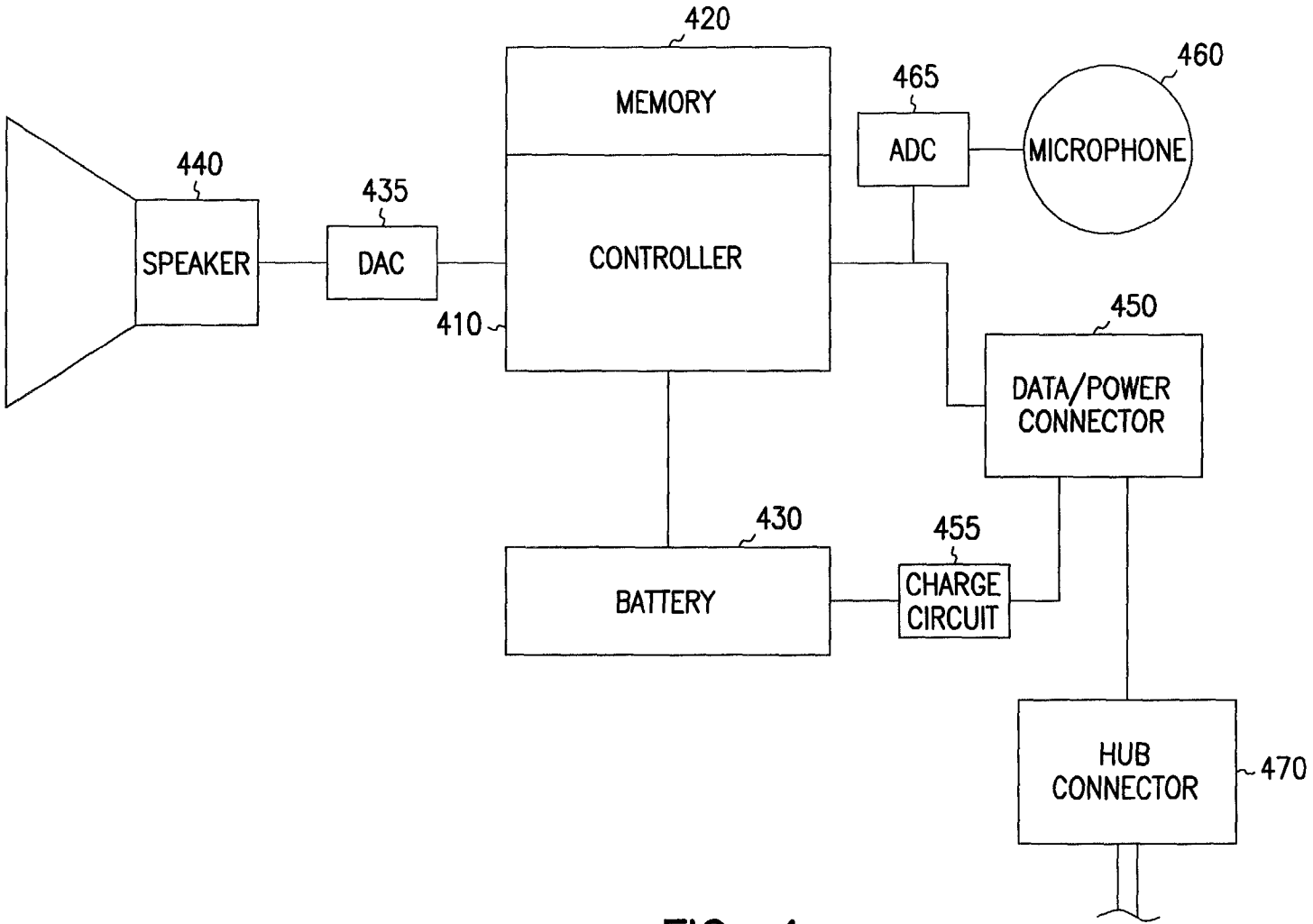
FIG. 4 is a block diagram of components of the audio player of FIGS. 1A and 1B.

Further details of the components that are incorporated into the embodiments of FIGS. 1–3 are shown in FIG. 4. In one embodiment, the components are integrated into a single wearable device for insertion in the ear canal or audio vestibule similar to standard hearing aides. A controller 410 is programmed or otherwise designed to create audio signals from digital audio signals stored in a memory 420. The digital audio signals are stored in an MP3 format in one embodiment. The controller processes MP3 files stored in memory 420 performs digital to analog conversion, and manages the memory and power maintenance.

A rechargeable or replaceable power source such as a battery 430 is coupled to the controller/memory for providing power thereto. The controller 410 or a separate DAC (digital-to-analog converter) 435 translates the digital audio signals into audio signals for conversion or sound via a speaker 440. The signals are analog signals in one embodiment. A data/power connector 450 is coupled to the battery 430 through a charge circuit 455 and to the controller 410. The data/power connector 450 comprises a pair of connector plates that attach to bead connectors in a cradle for recharging and provision of digital audio signals to the memory 420.

The cradle is shaped to mate with the player and fully support it during charging of the battery. A microphone 460 provides analog signals through an ADC (analog-to-digital converter) 465 to the controller 410 for use in the passthrough mode or as a microphone for the cell phone mode. A hub connector 470 is also coupled to the data/power connector for connecting hubs or clips.

Figure 5:
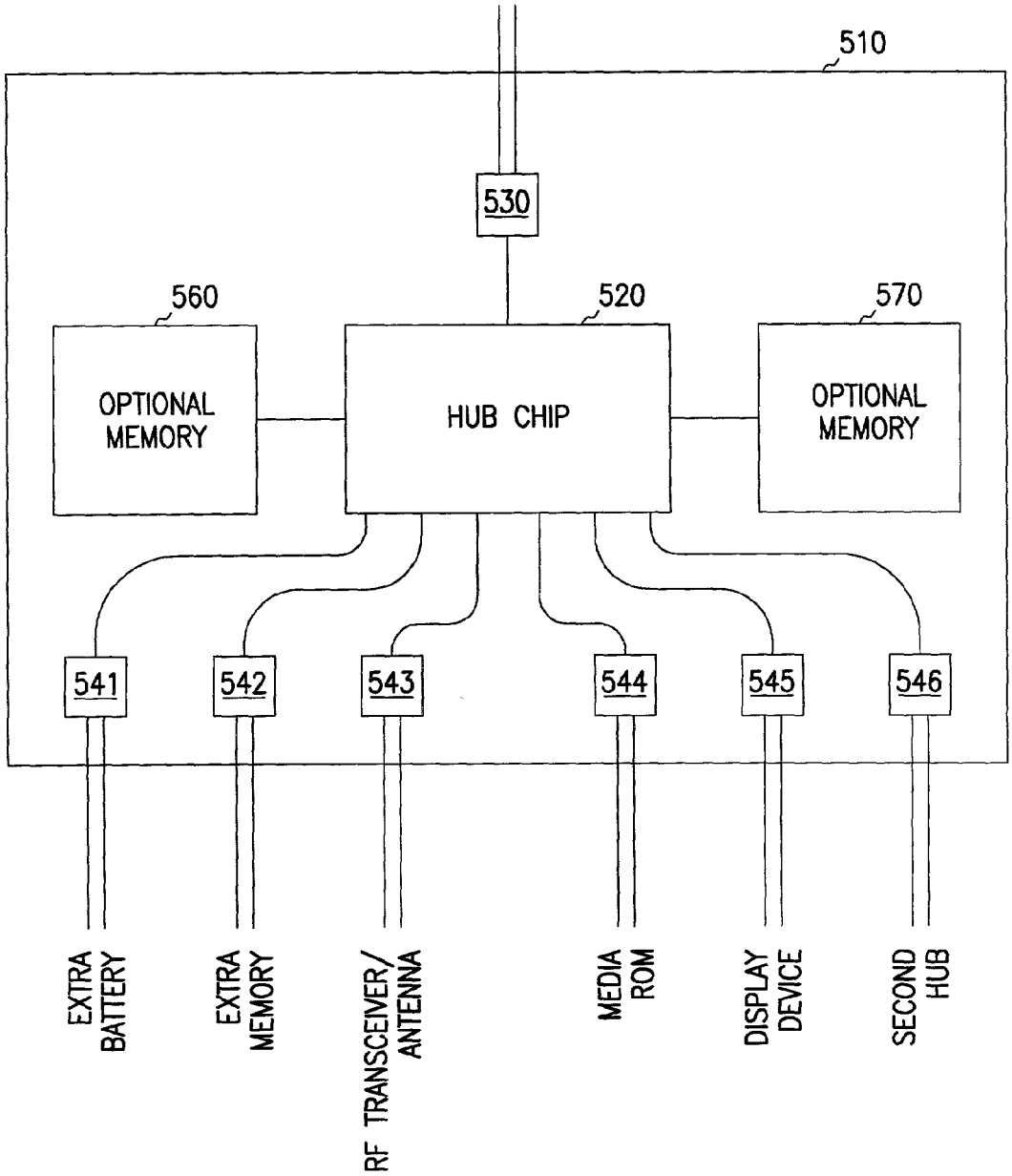
FIG. 5 is a block diagram of a hub of the audio player of FIGS. 1A and 1B.

FIG. 5 is a block diagram of a hub 510 of the audio player. The hub 510 comprises a hub chip 520 coupled to a connector 530 for connecting to the ear piece. The hub 510 is directly physically coupled to the ear piece, or attached by suitable conductors. Plural connectors are also shown for connecting peripheral devices. Connector 541 is for an extra battery. Connector 542 is for extra memory. Connector 543 is for a transceiver/antenna. Connector 544 is for media/ROM. Connector 545 supports a display device, and connector 546 is for supporting a second hub if desired. Optional memory 560 and optional battery 570 are also coupled to the hub chip 520 in hub 510 as desired.

CONCLUSION

A digital audio player is constructed in an ear module fully supported by the ear. Both in canal and ear bud with clip modules are described. The ear module contains all components required for storing and playing digitized audio. In one embodiment the audio player is an MP3 player or other player of the digital formats previously mentioned or otherwise existing or hereafter invented. The components may also be distributed to different elements also supported by the ear. A hub supported by the ear has a micro controller and connectors for receiving digitized audio. It alternatively comprises a battery for running the audio player. Further functions are provided by peripheral devices, also supported by the ear. Such devices include solar collectors, batteries, memory, display devices, ROM music releases and external control devices such as an on/off switch, volume control, track selection controls and others.

The invention claimed is:

1. An audio player comprising:

an ear module formed to be entirely supported by an ear, the ear module comprising:

a speaker;

a memory for storing digitized audio; and a player coupled to the speaker and memory that provides audio signals to the speaker based on the digitized audio.

2. The audio player of claim 1 wherein the ear module comprises a device selected from the group consisting of an in the canal device, a completely in the canal device, and an in the ear device.

3. The audio player of claim 1 wherein the ear module comprises an ear bud having an ear clip.

4. An audio player system comprising:

an ear module formed to be entirely supported by an ear; and a hub supported by the ear module that provides audio signals to the ear module based on stored digitized audio signals.

5. The audio player of claim 4 wherein the ear module comprises a speaker, and wherein the hub comprises a controller that converts the stored digitized audio signals to signals useable by the speaker.

6. The audio player of claim 4 wherein the stored digitized audio signals comprise signals in a format selected from the group consisting of MP3 (Moving Picture Experts Group Layer-3 Audio), RA (RealAudio), WMA (Windows Media Audio), ASF (Active Streaming Format), AU (Audio file), AUD (Audio file), AIF (Auxiliary Information File), ASX (Active Streaming XML), ASF (Active Streaming Format (Microsoft)), MIDI (Musical Instrument Digital Interface), RMI (Real Music Interface), SND (Sound file) WAV (Windows Audio Volume) WAX (Windows Audio Executable), or WM (Windows Media) signals.

7. The audio player of claim 4, wherein the hub comprises connectors for supporting and communicating with peripheral devices.

8. The audio player of claim 7 and further comprising a peripheral device coupled to the hub.

9. An audio player system comprising:

an ear module formed to be entirely supported by an ear;

a hub supported by the ear module that provides audio signals to the ear module based on stored digitized audio signals;

a peripheral device supported by the hub.

10. The audio player of claim 9 wherein the peripheral device is electrically coupled to the hub and is selected from the group consisting of a solar collector, battery, memory. RF receiver, RF transmitter, RF transceiver, data connector, memory carrier, ROM music release, display device, and control device.

11. The audio player of claim 9 wherein the hub comprises a player capable of playing signals in a format selected from the group consisting of MP3 (Moving Picture Experts Group Layer-3 Audio), RA (RealAudio), WMA (Windows Media Audio), ASF (Active Streaming Format), AU (Audio file), AUD (Audio file), A1F (Auxiliary Information Tile), ASX (Active Streaming XML), ASF (Active Streaming Format (Microsoft)), MIDI (Musical Instrument Digital Interface), RMI (Real Music Interface), SND (Sound file) WAV (Windows Audio Volume) WAX (Windows Audio Executable), or WM (Windows Media) signals.

12. The audio player of claim 9 wherein the peripheral device is formed to appear as jewelry.

13. The audio player of claim 12 wherein a musical band records music on peripheral devices formed to appear as a line of jewelry.

14. A peripheral device for an ear supported digitized audio player, the peripheral device comprising:

a connector adapted to connect to the audio player in a suspended relationship from the audio player; and a memory coupled to the connector that stores digitized audio, the memory being suspended from the connector to suspend the memory from the audio player.

15. The peripheral device of claim 14 wherein the digitized audio is stored in a format selected from the group consisting of MP3 (Moving Picture Experts Group Layer-3 Audio), RA (RealAudio), WMA (Windows Media Audio), ASF (Active Streaming Format), AU (Audio file), AUD (Audio file), AIF (Auxiliary Information File), ASX (Active Streaming XML), ASF (Active Streaming Format (Microsoft)), MIDI (Musical Instrument Digital Interface), RMI (Real Music Interface), SND (Sound file) WAV (Windows Audio Volume) WAX (Windows Audio Executable), or WM (Windows Media) signals.

16. A peripheral device for an ear supported digitized audio player, the peripheral device comprising:

a connector adapted to connect to the audio player in a suspended relationship from the audio player;

a memory coupled to the connector that stores digitized audio, the memory being suspended from the connector to suspend the memory from the audio player; and a decorative enclosure for the memory.

17. The peripheral device of claim 16 wherein the digitized audio is stored in a format selected from the group consisting of MP3 (Moving Picture Experts Group Layer-3 Audio), RA (RealAudio), WMA (Windows Media Audio), ASF (Active Streaming Format), AU (Audio file), AUD (Audio file), AIF (Auxiliary Information File), ASX (Active Streaming XML), ASP (Active Streaming Format (Microsoft)), MIDI (Musical Instrument Digital Interface), RMI (Real Music Interface), SND (Sound file) WAV (Windows Audio Volume) WAX (Windows Audio Executable), or WM (Windows Media) signals.

18. A method of packaging music comprising:

obtaining music in a digital format;

storing such digital format signals on a memory device;

encapsulating the memory device in a decorative enclosure; and suspending the memory device from a digitized audio player entirely supported by ail ear of a user of the player.

19. The method of packaging music of claim 18 wherein decorative enclosures for a selected recording group are similar.

20. The method of claim 18 wherein the digital format is selected from the group consisting of MP3 (Moving Picture Experts Group Layer-3 Audio), RA (RealAudio), WMA (Windows Media Audio), ASF (Active Streaming Format), AU (Audio file), AUD (Audio file), AIF (Auxiliary Information File), ASX (Active Streaming XML), ASF 20 (Active Streaming Format (Microsoft)), MIDI (Musical Instrument Digital Interface), RMI (Real Music Interface), SMD (Sound file) WAV (Windows Audio Volume) WAX (Windows Audio Executable), or WM (Windows Media) signals.

21. The audio player of claim 1 wherein the ear module is free of any other structure providing support on the body of a user when supported on the ear.

22. The audio player of claim 1 wherein a portion of the ear module is inserted into the ear when supported on the ear.

23. The audio player of claim 1 wherein the ear module fits substantially entirely within the ear of the user when supported on the ear.

* * * * *